US011719009B2

(12) United States Patent
MacKarvich

(10) Patent No.: US 11,719,009 B2
(45) Date of Patent: Aug. 8, 2023

(54) GUARDRAIL MOUNTING BRACKET

(71) Applicant: Charles J. MacKarvich, Alanta, GA (US)

(72) Inventor: Charles J. MacKarvich, Alanta, GA (US)

( * ) Notice: Subject to any disclaimer, the term of this patent is extended or adjusted under 35 U.S.C. 154(b) by 0 days.

(21) Appl. No.: 17/404,117

(22) Filed: Aug. 17, 2021

(65) Prior Publication Data

US 2023/0054380 A1 Feb. 23, 2023

(51) Int. Cl.
*E04G 21/32* (2006.01)

(52) U.S. Cl.
CPC ..... *E04G 21/3242* (2013.01)

(58) Field of Classification Search
CPC ..... E04G 21/3242; E04G 21/3233; E04G 21/3223; E04G 21/3204; E04G 5/045; B25B 5/006; B25B 5/02; B25B 5/102; Y10T 29/49998
USPC ..... 256/68
See application file for complete search history.

(56) References Cited

U.S. PATENT DOCUMENTS 1,239,462 A * 9/1917 Clinkunbroomer ..... B28B 7/225 249/189
2,907,598 A * 10/1959 Hart ..... A47B 91/02 403/112
3,385,400 A * 5/1968 Whitsett ..... E04G 5/06 248/246
3,480,242 A * 11/1969 Cleveland ..... E04G 21/3242 248/231.71
3,632,089 A * 1/1972 Smith ..... E04F 11/18 256/47
3,756,568 A * 9/1973 Mocny ..... E04G 21/3242 256/65.1
3,863,900 A * 2/1975 Dagiel ..... E04G 21/3233 248/231.71
3,881,698 A * 5/1975 Marsh ..... E04G 21/3233 248/231.41
3,920,221 A * 11/1975 Berry ..... E04G 21/3233 52/707
3,938,619 A * 2/1976 Kurabayashi ..... E04G 21/3233 182/113
3,995,833 A * 12/1976 McLaughlin ..... E04G 21/3242 256/65.14
3,995,834 A * 12/1976 Melfi ..... E04G 21/3233 256/59

(Continued)

OTHER PUBLICATIONS

Mackarvich, Charles J.; Non-Final Office Action for U.S. Appl. No. 17/404,069, filed Aug. 17, 2021, dated Mar. 22, 2022, 14 pgs.

(Continued)

*Primary Examiner* — Daniel P Cahn
*Assistant Examiner* — Shiref M Mekhaeil
(74) *Attorney, Agent, or Firm* — Taylor English Duma LLP

(57) ABSTRACT

A guardrail mounting bracket includes an upper bracket assembly comprising an upper support component and an upper clamp component; a lower bracket, wherein the upper clamp component is oriented between the upper support component and the lower bracket; and a clamp fastener supported by the upper support component and configured to engage the upper clamp component, the clamp fastener movable relative to the upper support component to selectively bias the upper clamp component towards the lower bracket.

19 Claims, 8 Drawing Sheets

(56) References Cited

U.S. PATENT DOCUMENTS 4,045,003 A * 8/1977 McCluskey ..... E04F 11/1812 256/59
4,078,633 A * 3/1978 Fahy ..... E04G 3/265 182/229
4,253,648 A * 3/1981 Meeks ..... B25B 5/16 269/282
4,457,397 A * 7/1984 Scala ..... E04G 1/24 182/116
4,669,577 A * 6/1987 Werner ..... E04G 21/3242 248/231.71
4,846,305 A * 7/1989 Kupfert ..... E06C 7/42 182/109
5,067,586 A * 11/1991 Myers ..... E04G 5/041 248/237
5,462,249 A * 10/1995 Calzone ..... B60P 1/43 292/256.73
5,527,016 A * 6/1996 Wilkerson, Jr. ..... E04F 21/00 52/64
6,038,829 A * 3/2000 Franks ..... E04G 21/3242 52/645
6,039,150 A * 3/2000 Palmer ..... E04G 21/3223 182/113
6,279,880 B1 * 8/2001 Hawks, Jr. ..... E04F 11/1834 403/109.1
6,328,285 B1 * 12/2001 Wiseman ..... E04H 12/2269 256/67
6,481,697 B1 * 11/2002 Brown ..... E04F 11/1834 256/64
6,585,080 B2 * 7/2003 Murray ..... E04G 21/3242 248/231.71
6,679,482 B2 * 1/2004 Allenbaugh ..... E04G 21/3242 248/231.71
7,063,186 B1 * 6/2006 Granke ..... E04G 21/3223 182/113
7,234,689 B2 * 6/2007 Kuenzel ..... E04G 21/3233 182/113
7,530,551 B2 * 5/2009 Kuenzel ..... E04G 21/3233 182/113
7,806,232 B2 * 10/2010 Thomas ..... E04G 21/3223 182/113
8,448,923 B1 * 5/2013 Schad ..... E04G 21/3219 256/65.03
8,833,008 B2 * 9/2014 Truckner ..... E04F 11/181 52/191
9,670,685 B2 * 6/2017 Landry ..... A62B 35/0068
9,683,372 B2 * 6/2017 Meier ..... E04F 13/22
10,487,522 B2 * 11/2019 Melic ..... E04G 21/3242
11,007,832 B1 * 5/2021 Rebick ..... B60D 1/52
11,499,327 B1 11/2022 Mackarvich
2003/0012621 A1 * 1/2003 Fletcher ..... E04G 25/061 411/513
2003/0097729 A1 * 5/2003 Kaufman ..... A47G 27/065 16/12
2003/0132427 A1 * 7/2003 Allenbaugh ..... E04G 21/3233 256/65.14
2005/0046100 A1 * 3/2005 Pang ..... B23K 37/04 269/244
2005/0072628 A1 * 4/2005 Riley ..... E04G 3/28 182/82
2008/0196330 A1 * 8/2008 Frank ..... E04H 3/12 52/182
2009/0266969 A1 * 10/2009 Costello ..... B28B 7/225 249/14
2011/0167740 A1 * 7/2011 Truckner ..... E04F 11/181 52/698
2018/0283022 A1 * 10/2018 Gentile ..... E04G 21/3242
2021/0331347 A1 * 10/2021 Glentz ..... B28B 7/225
2022/0056715 A1 * 2/2022 O'Mara ..... E04G 21/3242

OTHER PUBLICATIONS

Mackarvich, Charles J.; Requirement for Restriction/Election for U.S. Appl. No. 17/404,069, filed Aug. 17, 2021, dated Feb. 8, 2022, 8 pgs.
Mackarvich, Charles J.; Notice of Allowance for U.S. Appl. No. 17/404,069, filed Aug. 17, 2021, dated Aug. 1, 2022, 12 pgs.

* cited by examiner

GUARDRAIL MOUNTING BRACKET

TECHNICAL FIELD

This disclosure relates to building construction. More specifically, this disclosure relates to a mounting bracket for mounting a guardrail to an elevated surface.

BACKGROUND

Construction sites often have elevated surfaces, such as elevated floor slabs, that require guardrails or other safety measures to prevent accidental falls. Guardrails are typically placed at a perimeter of the elevated surface and must be secured in position in order to be effective. Guardrails that are not properly secured can move and can fail to prevent falls from the elevated surface.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a guardrail mounting bracket comprising an upper bracket assembly comprising an upper support component and an upper clamp component; a lower bracket, wherein the upper clamp component is oriented between the upper support component and the lower bracket; and a clamp fastener supported by the upper support component and configured to engage the upper clamp component, the clamp fastener movable relative to the upper support component to selectively bias the upper clamp component towards the lower bracket.

Also disclosed is a guardrail system comprising a plurality of guardrails defining an upright boundary, the plurality of guardrails comprising a guardrail post, the guardrail post defining an upper section and a lower section; and a guardrail mounting bracket comprising: a bracket mounted to one of the upper section and the lower section of the guardrail post; and a bracket assembly mounted to the other of the upper section and the lower section, the bracket assembly comprising a clamp component configured to be selectively biased towards the bracket.

A method of mounting a guardrail system to an elevated slab, the method comprising providing a guardrail system comprising a bracket, a bracket assembly, and a plurality of guardrails, each of the bracket and the bracket assembly mounted to a guardrail post of the plurality of guardrails; abutting the bracket against one of an upper slab surface and a lower slab surface of the elevated slab; and tightening a clamp fastener against a clamp component of the bracket assembly, wherein tightening the clamp fastener against the clamp component biases the clamp component against the other of the upper slab surface and the lower slab surface of the elevated slab.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
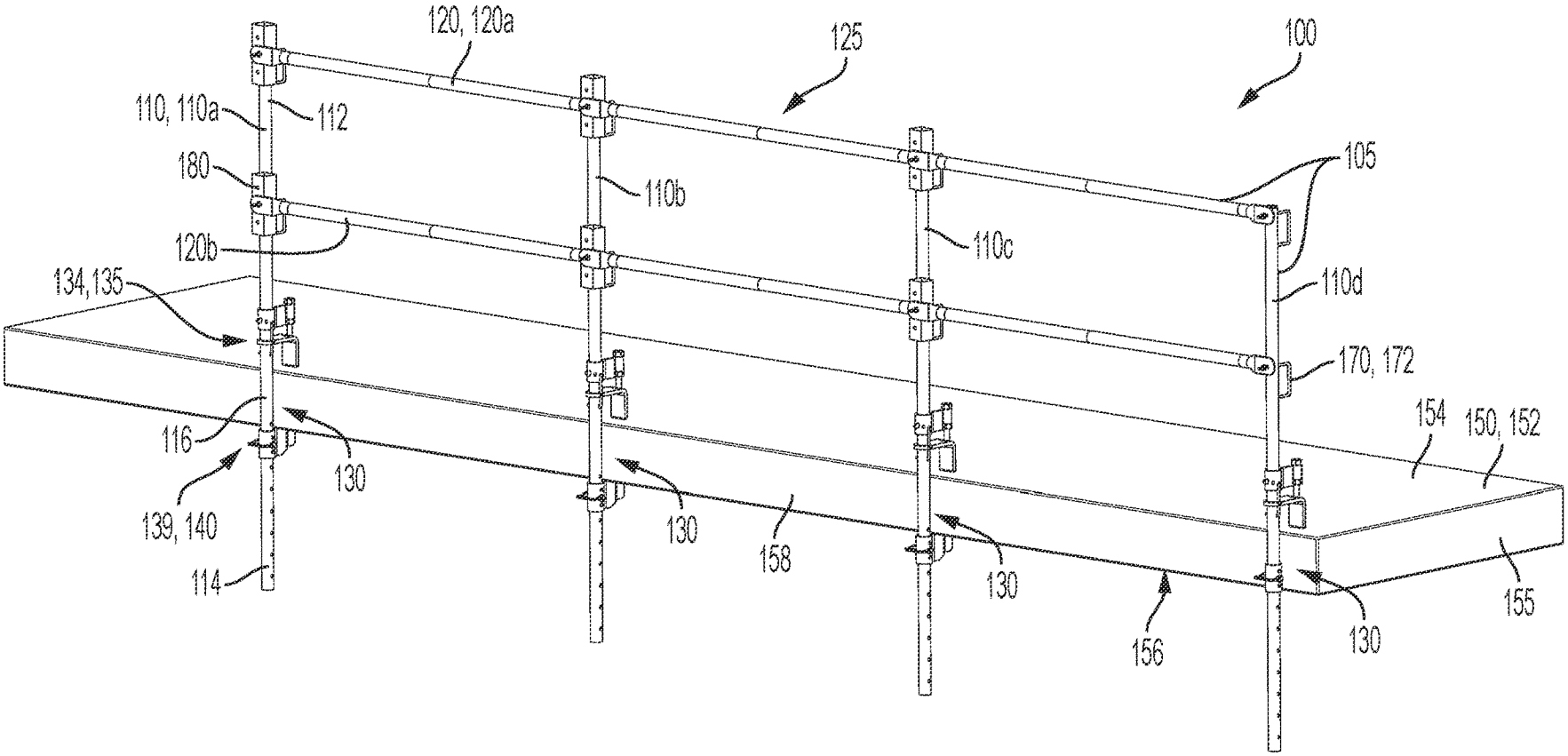
FIG. 1 is a perspective view of a guardrail system comprising a plurality of guardrails and a plurality of guardrail mounting brackets, in accordance with one aspect of the present disclosure, wherein the guardrail system is mounted to an elevated surface.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed in the present application is a guardrail mounting bracket and associated methods, systems, devices, and various apparatus. The guardrail mounting bracket can comprise an upper bracket assembly and a lower bracket. It would be understood by one of skill in the art that the disclosed guardrail mounting bracket is described in but a few exemplary aspects among many. No particular terminology or description should be considered limiting on the disclosure or the scope of any claims issuing therefrom.

FIG. 1 illustrates a guardrail system 100 mounted to an elevated slab 150, in accordance with a first aspect of the present disclosure. The guardrail system 100 can comprise a plurality of guardrails 105 and one or more guardrail mounting brackets 130 for mounting the guardrails 105 to the elevated slab 150. According to example aspects, the guardrails 105 can comprise a plurality of guardrails posts 110 and a plurality of lateral guardrails 120. Example aspects of the guardrails 105 can comprise steel. In some aspects the guardrails 105 can be formed as extruded steel posts. In other aspects, the guardrails 150 can comprise any other suitable material known in the art, including but not limited to other metals, and/or can be manufactured using any other desired method. The guardrail posts 110 can be oriented about vertically and the lateral guardrails 120 can extend laterally therebetween. The lateral guardrails 120 can be oriented about horizontally, or can be oriented at an acute angle relative to horizontal. In the present aspect, the guardrail posts 110 comprise a pair of intermediate guardrail posts 110*b,c* and a pair of end guardrail posts 110*a,d*, wherein the intermediate guardrail posts 110*b,c* can be oriented between the pair of end guardrail posts 110*a,d*. Furthermore, the lateral guardrails 120 can comprise an upper lateral guardrail 120*a* and a lower lateral guardrail 120*b* extending between each adjacent pair of guardrail posts 110. In the present aspect, the end guardrail post 110*d* can be directly secured to each of the corresponding upper and lower lateral guardrails 120*a,b* by a securing fastener 170, such as a securing pin 172, and each of the remaining guardrail posts 110 (end guardrail post 110*a* and the intermediate guardrails) can be secured to each of the corresponding upper and lower lateral guardrails 120*a,b* by a connector bracket 180. In some aspects, each of the connector brackets 180 can comprise a one of the securing pins 172, as described in further detail below with respect to FIGS. 10 and 11. In other aspects, the guardrail posts 110 and lateral guardrails 120 can be secured together by any other suitable type of fastener, such as screws, bolts, rivets, and the like, or by any other suitable attachment method known in the art. When secured together, the guardrail posts 110 and lateral guardrails 120 can define a substantially upright boundary 125, as shown.

The elevated slab 150 can be, for example, an elevated floor slab 152, as shown, such as found in a commercial building, such as high-rise offices and hotels. Example aspects of the elevated floor slab 152 can comprise concrete or any other suitable material. The elevated floor slab 152 can be oriented substantially horizontally, and define an upper slab surface 154 and a lower slab surface 156 opposite the upper slab surface 154. The elevated floor slab 152 can further define a peripheral edge 155, and the guardrail system 100 can be mounted to the elevated floor slab 152 at the peripheral edge 155. For example, in the present aspect, the guardrail system 100 can be mounted to the elevated floor slab 152 at a front side 158 of the peripheral edge 155, relative to the orientation shown. Thus, the upright boundary 125 created by the guardrails 105 can prevent accidental falls off the elevated slab 150 at the front side 158 thereof. In other aspects, the guardrail system 100 can be mounted at any suitable location around the peripheral edge 155. In some aspects, the guardrail system 100 can partially surround the peripheral edge 155 of the elevated floor slab 152, and in other aspects, the guardrail system 100 can fully surround the peripheral edge 155 of the elevated floor slab 152. In the present aspect, each of the guardrail posts 110 can define an upper section 112, a lower section 114, and an intermediate section 116 extending between the upper section 112 and the lower section 114. The intermediate section 116 of each guardrail post 110 can extend along the front side 158 of the elevated floor slab 152 between the upper slab surface 154 and the lower slab surface 156 thereof, the upper section 112 can extend upward from the intermediate section 116 beyond the upper slab surface 154, and the lower section 114 can extend downward from the intermediate section 116 beyond the lower slab surface 156. The lateral guardrails 120 can be attached to the upper sections 112 of the guardrail posts 110.

According to example aspects, the guardrail mounting brackets 130 of the guardrail system 100 can be provided to secure the upright boundary 125 to the elevated floor slab 152. Securing the upright boundary 125 to the elevated floor slab 152 can prevent movement thereof and ensure safe and proper functioning of the guardrail system 100. In example aspects, each of the guardrail mounting brackets 130 can comprise a bracket assembly 134 and a bracket 139. For example, the bracket assembly 134 can be an upper bracket assembly 135 and the bracket 139 can be a lower bracket 140, as shown. In the present aspect, the bracket assembly 134 (e.g., the upper bracket assembly 135) can be configured to engage the upper slab surface 154 of the elevated floor slab 152, and the bracket 139 (e.g., the lower bracket 140) can be configured to engage the lower slab surface 156 of the elevated floor slab 152, such that the elevated floor slab 152 can be clamped between the lower bracket 140 and the upper bracket assembly 135. As shown, the upper bracket assembly 135 of each guardrail mounting bracket 130 can be attached to the upper section 112 of a corresponding guardrail post 110 proximate to the upper slab surface 154, and the lower bracket 140 of each guardrail mounting bracket 130 can be attached to the lower section 114 of a corresponding guardrail post 110 proximate to the lower slab surface 156. In other aspects, the bracket assembly 134 can be attached to the lower section 114 and can be configured to engage the lower slab surface 156 of the elevated floor slab 152, and the bracket 139 can be attached to the upper section 112 and can be configured to engage the upper slab surface 154 of the elevated floor slab 152.

Each lower bracket 140 can be selectively repositioned along the corresponding guardrail post 110 between at least a first position and a second position, as described in further detail below, to accommodate elevated floor slabs 152 of varying thicknesses. In the first position, the lower bracket 140 can spaced from the corresponding upper bracket assembly 135 by a first distance, and in the second position, the lower bracket 140 can be spaced from the corresponding upper bracket assembly 135 by a second distance, wherein the second distance can be greater than the first distance. In some aspects, the upper bracket assembly 135 can also or alternatively be repositionable along a length of the corresponding guardrail post 110. In some aspects, neither of the upper bracket assembly 135 and lower bracket 140 may be repositionable. Furthermore, in the present aspect, the upper bracket assembly 135 can be selectively tightened against the upper slab surface 154 of the elevated floor slab 152 to securely mount the guardrail system 100 to the elevated floor slab 152.

Figure 2:
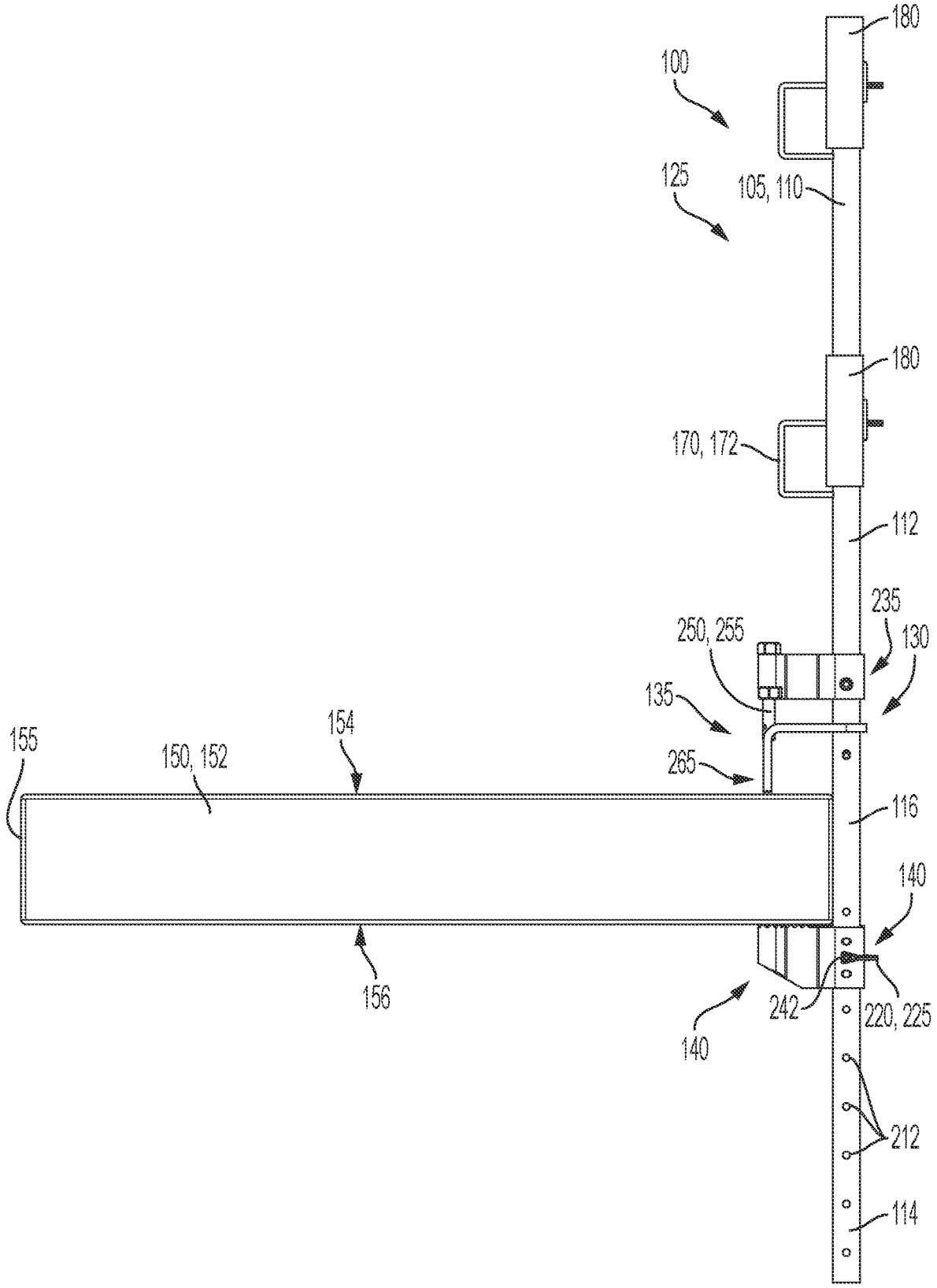
FIG. 2 is a side view of the guardrail system of FIG. 1.

FIG. 2 illustrates a side view of the guardrail system 100 mounted to the elevated floor surface. In example aspects, each of the guardrail posts 110 can define one or more lower positioning openings, such as lower pinholes 212, formed therethrough. In the present aspect, a plurality of the lower pinholes 212 can be spaced apart along a length of the lower section 114 of the guardrail post 110. The lower bracket 140 can be slidably mounted on the lower section 114 and can define a lower bracket opening 242 formed therethrough. The lower bracket opening 242 can be aligned with a desired one of the lower pinholes 212, and a positioning fastener 220, such as a positioning pin 225, can extend through the aligned lower bracket opening 242 and lower pinhole 212 to selectively secure the lower bracket 140 in position relative to the guardrail post 110. To reposition the lower bracket 140 on the lower section 114, for example to accommodate elevated slabs 150 of varying thickness, the positioning fastener 220 can be removed, and the lower bracket opening 242 can be realigned with a different one of the lower pinholes 212. The positioning pin 225 can then be reinserted through the aligned lower bracket opening 242 and the different lower pinhole 212 to re-secure the lower bracket 140 in the adjusted position. Once the lower brackets 140 are in the desired position, the guardrail system 100 can be oriented to abut each of the lower brackets 140 against the lower slab surface 156 of the elevated floor slab 152, as shown. In other aspects, the positioning fastener 220 can be any other suitable fastener known in the art, such as a screw, bolt, or the like, or the lower bracket 140 can be selectively positioned by any other suitable securing method known in the art, such as by a spring-loaded button on the guardrail post 110 engaging the lower bracket opening 242.

According to example aspects, the upper bracket assembly 135 of each guardrail mounting bracket 130 can comprise an upper support component 235 and an upper clamp component 265. The upper support component 235 can be fixedly mounted to the upper section 112 of the corresponding guardrail post 110, and the upper clamp component 265 can be movably mounted to the upper section 112 of the corresponding guardrail post 110 between the upper support component 235 and the upper slab surface 154 of the elevated floor slab 152. Thus, the front side 158 of the support slab can be vertically oriented between the upper clamp component 265 and the lower bracket 140, as shown. A clamp fastener 250, such as a threaded bolt 255, can be supported by the upper support component 235 and can be selectively tightened against the upper clamp component 265 to selectively bias the upper clamp component 265 against the upper slab surface 154, thereby clamping the elevated floor slab 152 between the lower bracket 140 and the upper clamp component 265. The clamp fastener 250 can also be selectively loosened in order to readjust or remove the guardrail system 100 from the elevated floor slab 152. In other aspects, the clamp fastener 250 can be any other suitable fastener known in the art.

Figure 3:
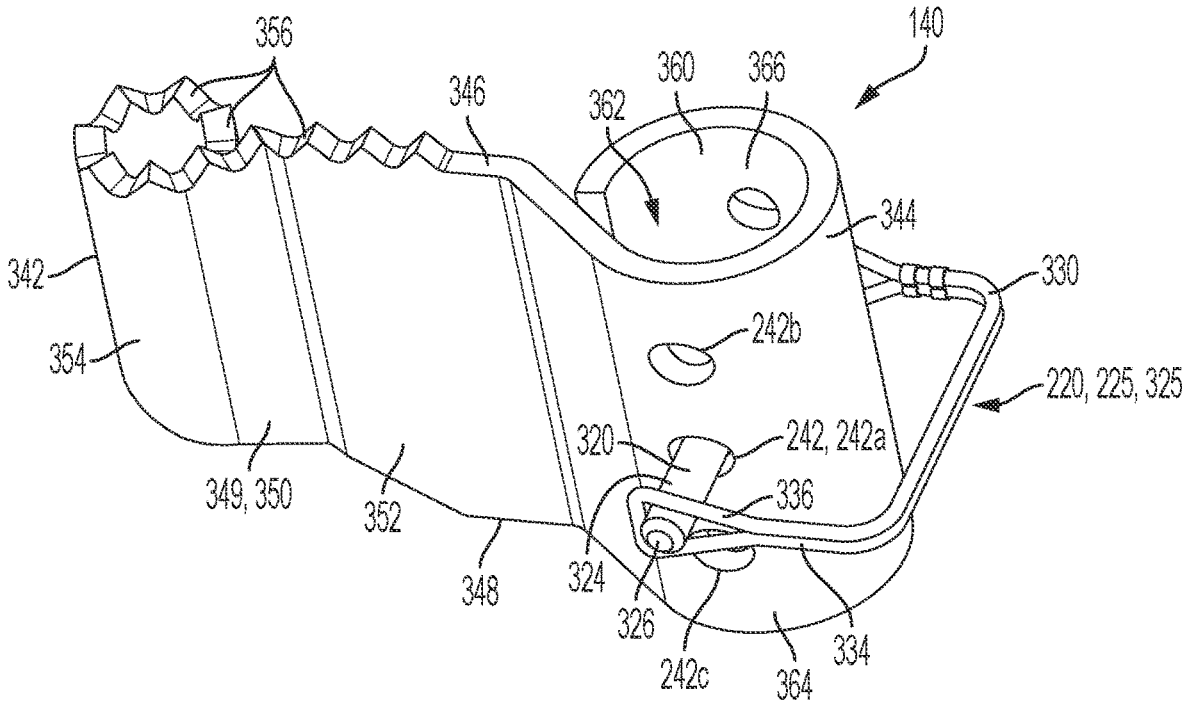
FIG. 3 is a perspective view of a lower bracket of one of the guardrail mounting brackets of FIG. 1.
Figure 4:
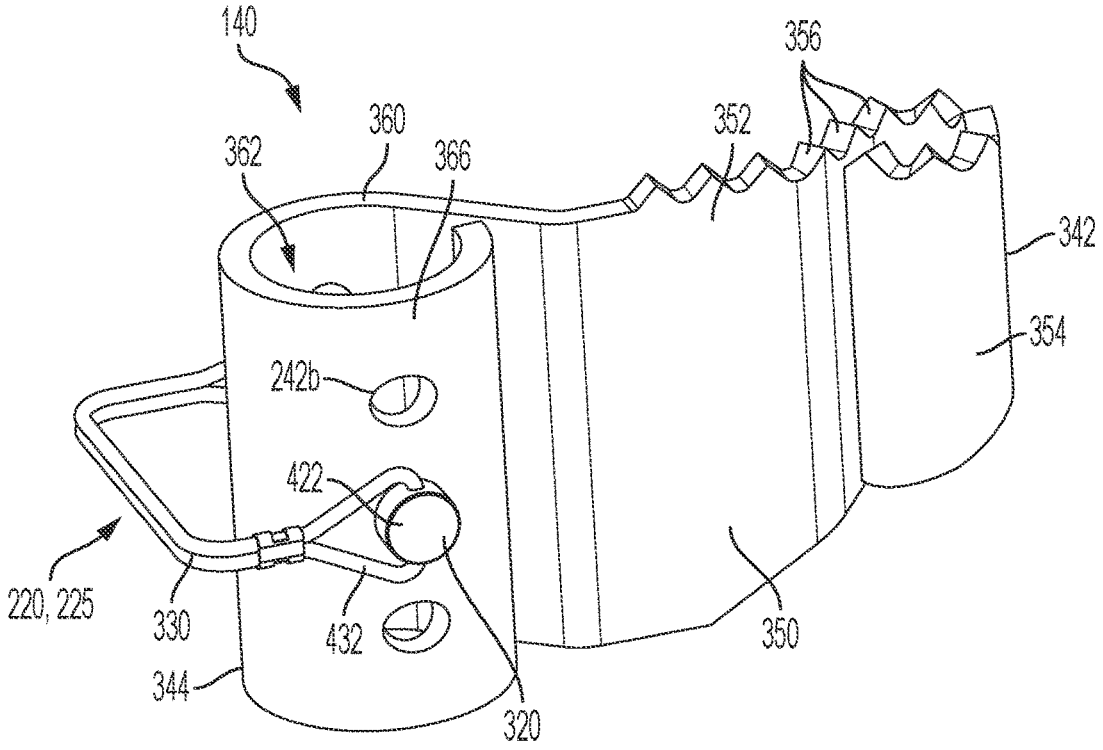
FIG. 4 is another perspective view of the lower bracket of FIG. 3.

FIGS. 3 and 4 illustrate perspective views of the lower bracket 140 in accordance with an example aspect of the present disclosure. The lower bracket 140 can define a first end 342, a second end 344 opposite the first end 342, an upper end 346, and a lower end 348 opposite the upper end 346. A slab contacting portion 349, such as a support portion 350, can be defined at the first end 342 and can extend towards the second end 344, and a lower post engagement portion 360 can be defined generally at the second end 344. In example aspects, the lower post engagement portion 360 and the slab support portion 350 can be monolithically formed (i.e., formed a singular component that constitutes a single material without joints or seams). Example aspects of the lower bracket 140 can comprise a rigid material having a durability suitable for clamping onto the elevated slab 150. For example, the lower bracket 140 can comprise steel in some aspects. More specifically, in some aspects, the lower bracket 140 can be formed by laser-cutting and bending monolithic steel plates. However, in other aspects, the lower bracket 140 may not be monolithically formed and/or may be manufactured using other desired methods, such as stamping, casting, or machining. In other aspects, the lower bracket 140 can comprise any other suitable material or combination of materials having suitable durability, such as, for example, other metals, plastics, composites, and the like.

According to example aspects, the lower post engagement portion 360 can be substantially tubular and can define a lower rail channel 362 therethrough. In some aspects, the lower bracket 140 can be bent at the second end 344 to define the tubular lower post engagement portion 360. The lower section 114 (shown in FIG. 1) of a corresponding guardrail post 110 (shown in FIG. 1) can extend through the lower rail channel 362. The lower bracket opening 242 can extend through a front side 364 of the lower post engagement portion 360 and a rear side 366 of the lower post engagement portion 360 and can be transverse to the lower rail channel 362. Furthermore, the lower bracket opening 242 can be oriented about perpendicular to the slab support portion 350. In the present aspect, the lower bracket opening 242 can be a primary lower bracket opening 242*a*, and the lower post engagement portion 360 can further define a pair of secondary lower bracket openings 242*b,c* formed therethrough. Other aspects can define more or fewer lower bracket openings 242.

In example aspects, the positioning fastener 220 can be the positioning pin 225, as shown. Specifically, in some aspects, the positioning pin 225 can be a lock pin 325. As noted above, in other aspects, the positioning fastener 220 can be any other suitable type of pin or fastener known in the art. The positioning pin 225 can define a straight pin rod 320 and a substantially D-shaped pin lock 330. In other aspects, the pin lock 330 can be substantially C-shaped or can define any other suitable shape. The pin rod 320 can define a pin head 422 (shown in FIG. 4) and a pin tail 324 extending therefrom. The pin head 422 can be configured to abut the rear side 366 of the lower post engagement portion 360 external to the lower rail channel 362. The pin tail 324 can extend through the primary lower bracket opening 242*a* and across the lower rail channel 362, such that a distal end 326 of the pin tail 324 can extend outward from the front side 354 of the lower post engagement portion 360. When the lower bracket 140 is mounted to the corresponding guardrail post 110, the pin tail 324 can further extend through the corresponding lower pinhole 212 that can be aligned with the primary lower bracket opening 242*a*, thereby selectively fixing the lower bracket 140 in position relative to the guardrail post 110. In other aspects, the orientation of the pin lock 330 can be reversed, such that the pin head 422 can abut the front side 354 of the lower post engagement portion 360 and the distal end 326 of the pin tail 324 can extend outwardly beyond the rear side 366 of the lower post engagement portion 360.

Furthermore, the pin lock 330 can oriented in a locked configuration, as shown, to prevent accidental removal or dislodging of the positioning pin 225. In some aspects, the pin lock 330 can be formed from a flexible wire to allow the pin lock 330 to be flexibly moved between the locked configuration and an unlocked configuration. The pin lock 330 can define a first end 432 (shown in FIG. 4) coupled to the pin head 422 and a second end 334 oriented proximate to the distal end 326 of the pin tail 324. The flexible wire of the pin lock 330 at the first end 432 can extend through a hole in the pin head 422 to couple the pin lock 330 to the pin head 422, and the pin lock 330 can extend therefrom around an outside of the lower post engagement portion 360. A locking loop 336 or locking hook can be defined at the second end 334 of the pin lock 330. To secure the pin lock 330 in the locked configuration, the locking loop 336 can be hooked onto the distal end 326 of the pin tail 324 to prohibit the distal end 326 of the pin tail 324 from passing through the primary lower bracket opening 242*a*.

Figure 5:
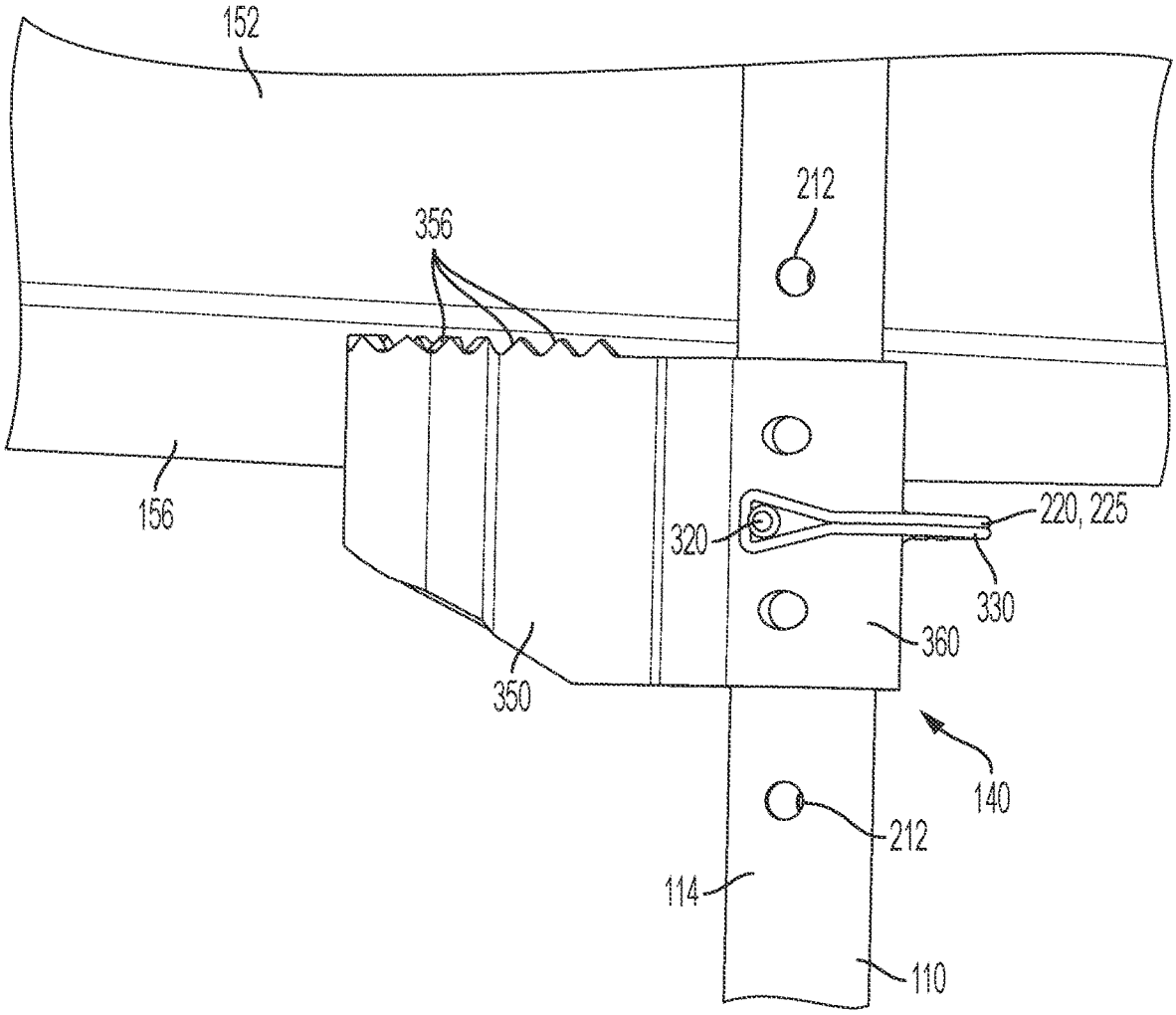
FIG. 5 is a perspective view of the lower bracket of FIG. 3 engaging a lower slab surface of the elevated surface of FIG. 1.

In example aspects, as shown, the slab support portion 350 of the lower bracket 140 can define a vertically-oriented slab support wall 352 extending from the lower post engagement portion 360 and a vertically-oriented tubular slab support 354 distal to the lower post engagement portion 360. In some example aspects, the lower bracket 140 can be bent into a tubular shape at the first end 342 to define the tubular slab support 354. In other aspects, the slab support portion 350 can define any other suitable configuration. According to example aspects, each of the slab support wall 352 and the tubular slab support 354 can define a plurality of lower teeth 356 extending substantially upward, relative to the orientation shown, at the upper end 346 of the lower bracket 140. Other aspects of the slab support portion 350 may not define the lower teeth 356, or can define more or fewer lower teeth 356. Referring to FIG. 5, which illustrates the lower bracket 140 engaging the elevated floor slab 152, the lower teeth 356 can be configured to grip the lower slab surface 156 of the elevated floor slab 152 to prevent sliding or movement of the lower bracket 140 along the lower slab surface 156.

Figure 7A:
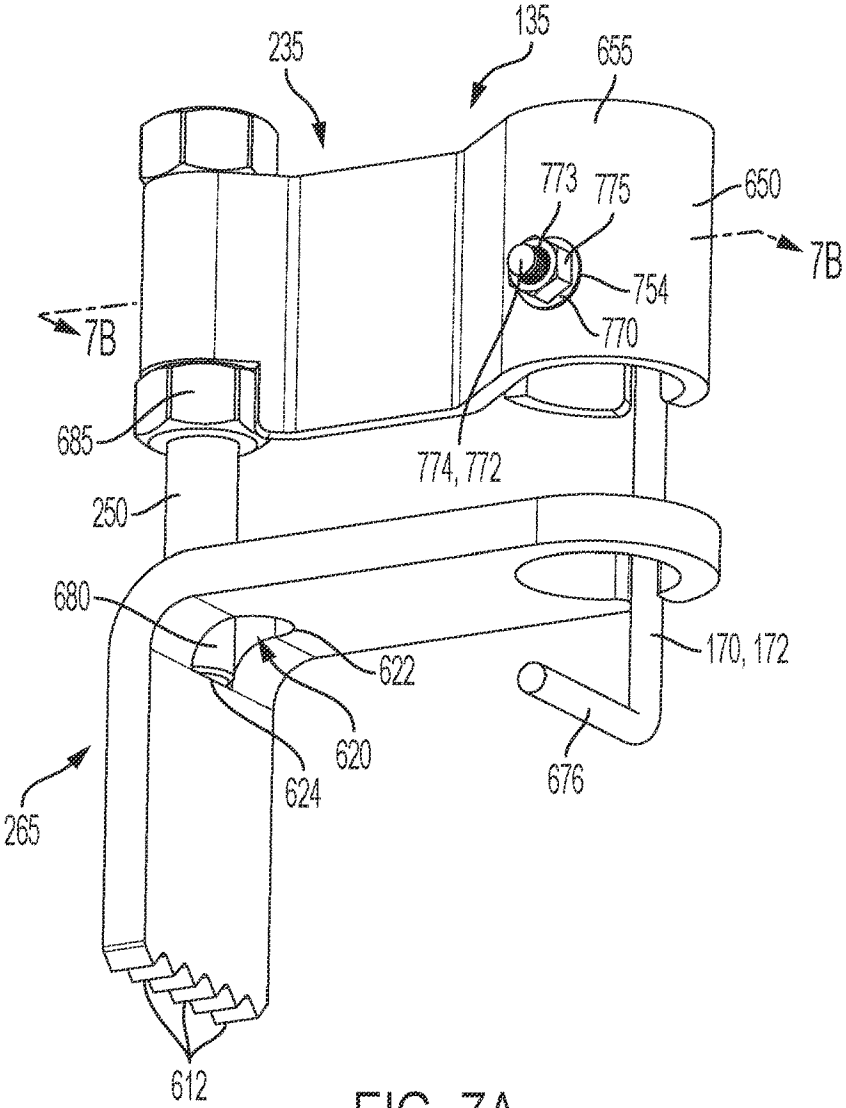
FIG. 7A is another perspective view of the upper bracket assembly of FIG. 6.
Figure 6:
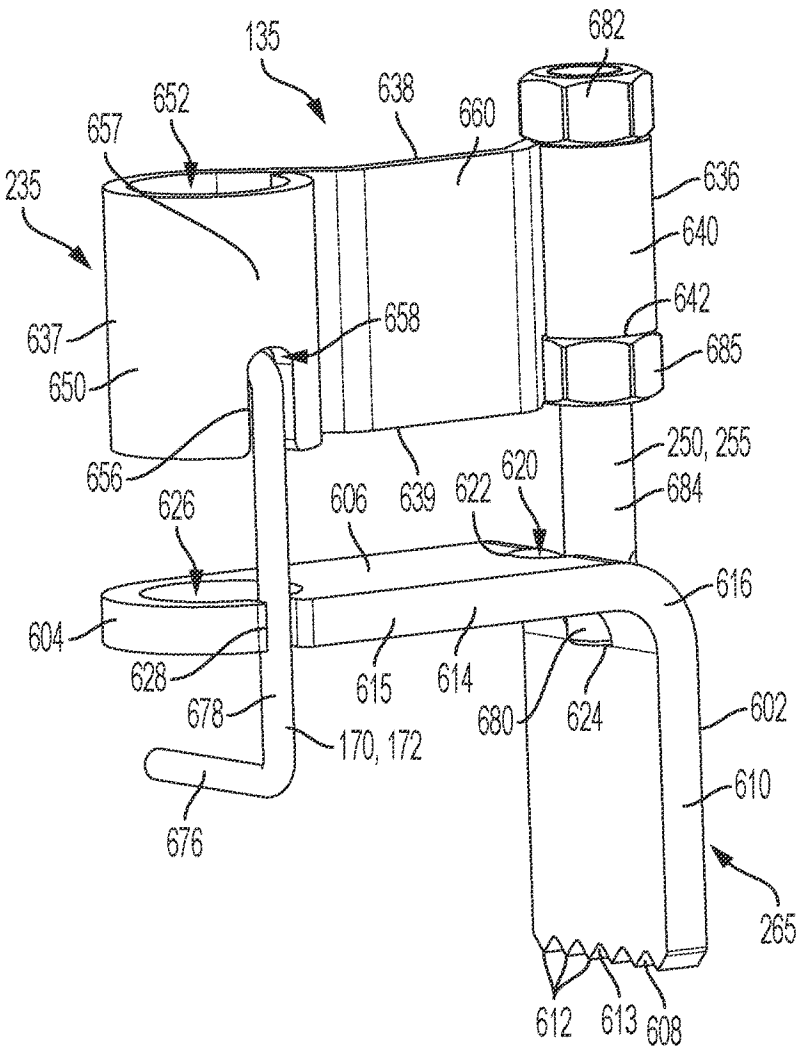
FIG. 6 is a perspective view of an upper bracket assembly of one of the guardrail mounting brackets of FIG. 1.
Figure 7B:
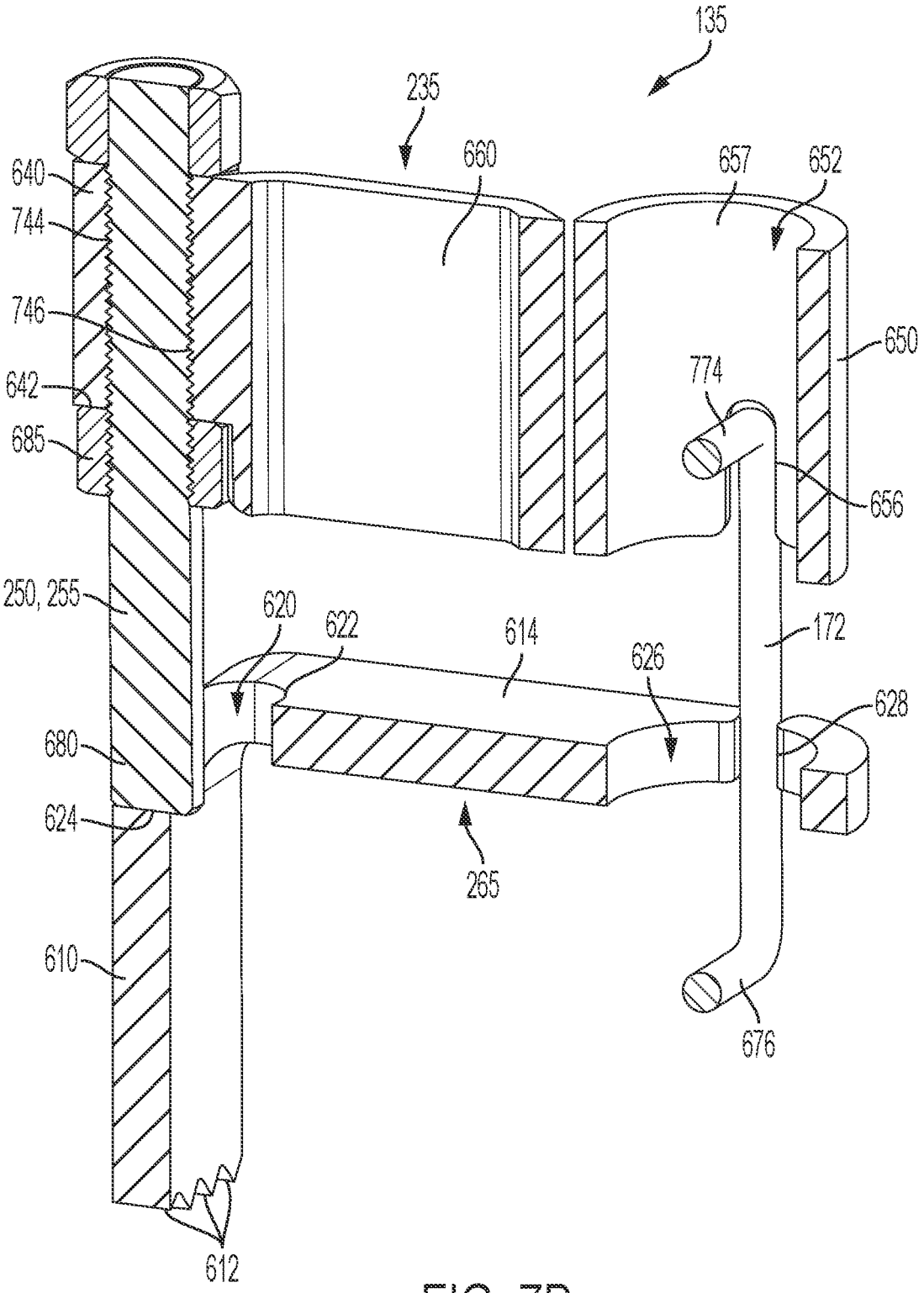
FIG. 7B is a cross-sectional view of the upper bracket assembly of FIG. 6 taken along line 7B-7B in FIG. 7A.

FIG. 6 illustrates a rear perspective view and 7A illustrates a front perspective view of the upper bracket assembly 135, in accordance with an example aspect of the present disclosure. FIG. 7B illustrates a cross-sectional view of the upper bracket assembly 135 taken along line 7B-7B in FIG. 7A. As shown, the upper bracket assembly 135 can comprise the upper support component 235 and the upper clamp component 265. Referring to FIG. 6, the upper support component 235 can define a first end 636, a second end 637 opposite the first end 636, an upper end 638, and a lower end 639 opposite the upper end 638. A fastener support portion 640 can be defined at the first end 636, an upper post engagement portion 650 can be defined generally at the second end 637, and a connecting wall 660 can extend therebetween. Each of the fastener support portion 640, upper post engagement portion 650, and connecting wall 660 can be substantially vertically oriented, relative to the orientation shown. In example aspects, the upper support component 235 can be monolithically formed (i.e., formed a singular component that constitutes a single material without joints or seams). In other aspects, the upper support component 235 may not be monolithically formed. Example aspects of the upper support component 235 and/or the upper clamp component 265 can comprise a rigid material having a durability suitable for clamping onto the elevated slab 150. For example, the upper support component 235 and the upper clamp component 265 can comprise steel in some aspects. More specifically, in some aspects, each of the upper support component 235 and the upper clamp component 265 can be formed by laser-cutting and bending monolithic steel plates. However, in other aspects, the upper support component 235 and/or the upper clamp component 265 may not be monolithically formed and/or may be manufactured using other desired methods, such as stamping, casting, or machining. In other aspects, the upper support component 235 and/or the upper clamp component 265 can comprise any other suitable material or combination of materials having suitable durability, such as, for example, other metals, plastics, composites, and the like.

Figure 8:
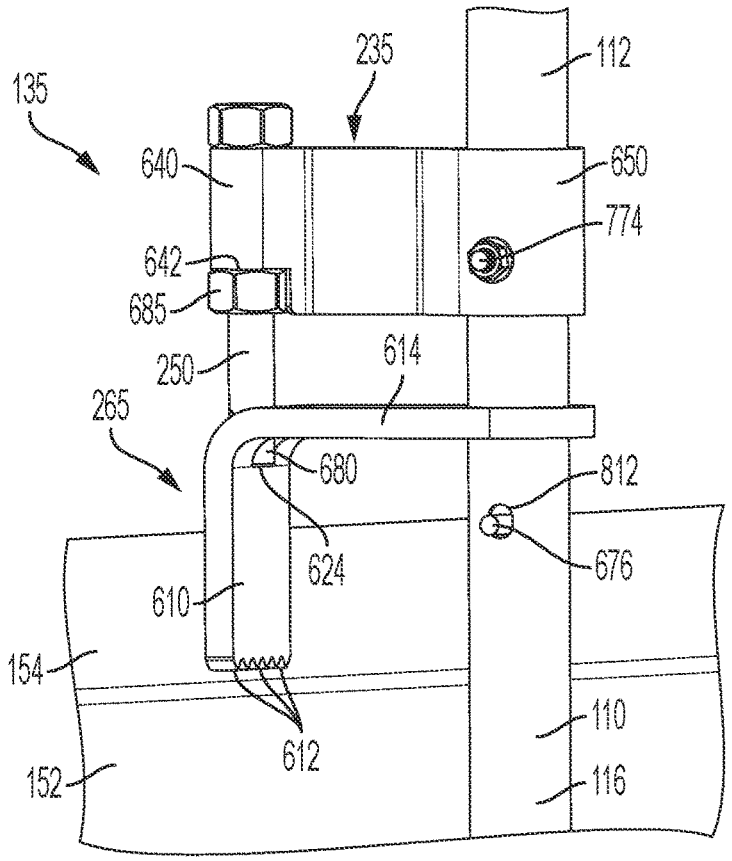
FIG. 8 is a perspective view of the upper bracket assembly of FIG. 6 engaging an upper slab surface of the elevated surface of FIG. 1.

According to example aspects, the upper post engagement portion 650 can be substantially tubular and can define an upper rail channel 652 therethrough. In some aspects, the upper support component 235 can be bent into a tubular shape at the second end 637 to define the upper post engagement portion 650. The upper section 112 of a corresponding guardrail post 110 (shown in FIG. 1) can extend through the upper rail channel 652. Furthermore, an upper bracket hole 754 (shown in FIG. 7A) can extend through a front side 655 (shown in FIG. 7A) of the upper post engagement portion 650, and an upper bracket slot 656 can be defined in a rear side 657 of the upper post engagement portion 650. The upper bracket slot 656 can extend from the lower end 639 of the upper support component 235 towards the upper end 638 thereof. The upper bracket hole 754 and the upper bracket slot 656 can together define an upper bracket opening 658 that can be substantially transverse to the upper rail channel 652. In example aspects, the upper section 112 of the guardrail post 110 can define one or more upper positioning openings, such as upper pinholes 812 (shown in FIG. 8), formed therethrough, and one of the upper pinholes 812 can be aligned with the upper bracket slot 656 and the upper bracket hole 754 (i.e., aligned with the upper bracket opening 658). In some aspects, another one of the upper pinholes 812 can be oriented between the upper clamp component 265 and the intermediate section 116 of the guardrail post 110, as shown in FIG. 8.

The upper bracket assembly 135 can further comprise a one of the securing pins 172 configured to secure the upper support component 235 in position relative to the corresponding guardrail post 110. As shown, in the present aspect, the securing pin 172 can be substantially D-shaped and can define an upper leg 774 (shown in FIG. 7A), a lower leg 676, and cross-rod 678 extending therebetween. The upper leg 774 of the securing pin 172 can extend through the upper bracket slot 656 and the upper bracket hole 754, transverse to the upper rail channel 652, as shown. When the upper section 112 of the guardrail post 110 is received through the upper rail channel 652, to retain the upper support component 235 in position relative to the guardrail post 110, the upper leg 774 can extend through the corresponding upper pinhole 812 aligned with the upper bracket slot 656 and the upper bracket hole 754, and the lower leg 676 of the securing pin 172 can extend through the upper pinhole 812 oriented between the upper clamp component 265 and the intermediate section 116. As shown in FIG. 7A, in some aspects, a distal end 772 of the upper leg 774 can define a threaded portion 773. A washer 770 and a threaded pin nut 775 can be mounted to the threaded portion 773, and the threaded pin nut 775 can be tightened towards the front side 655 of the upper post engagement portion 650 to sandwich the washer 770 between the threaded pin nut 775 and the upper post engagement portion 650. The washer 770 and threaded pin nut 775 can serve to prevent the upper leg 774 from disengaging the upper bracket hole 754. In other aspects, the securing fastener 170 can define any other suitable shape or configuration.

Referring again to FIG. 6, according to example aspects, the connecting wall 660 can be substantially planar and the fastener support portion 640 can be substantially tubular, as shown. In some aspects, the upper support component 235 can be bent into a tubular shape at the first end 636 to define the fastener support portion 640. The fastener support portion 640 can define a fastener channel 744 (shown in FIG. 7B) therethrough, and can further define a notch 642 at the lower end 639 of the upper support component 235. The clamp fastener 250 can be the threaded bolt 255, for example, and can define a fastener head 682 and a threaded fastener tail 684 extending therefrom. The fastener head 682 can be configured to abut the fastener support portion 640 at the upper end 638 of the upper support component 235, and the threaded fastener tail 684 can extend through the fastener channel 744 and beyond the lower end 639 of the upper support component 235. The fastener channel 744 can be threaded and can define internal threading 746 (shown in FIG. 7B) configured to mate with the threaded fastener tail 684. Furthermore, in some aspects, a threaded fastener nut 685 can be rotatably mounted on the threaded fastener tail 684, and can be tightened on the threaded fastener tail 684 within the notch 642 to abut the lower end 639 of the upper support component 235.

Example aspects of the upper clamp component 265 can be substantially L-shaped, as shown. In other aspects, the upper clamp component 265 can define any other suitable shape. The upper clamp component 265 can define a first end 602, a second end 604 opposite the first end 602, an upper end 606, and a lower end 608 opposite the upper end 606. A substantially vertical clamp wall 610 can be defined at the first end 602, extending from the upper end 606 to the lower end 608, and a substantially horizontal clamp wall 614 can extend from the first end 602 to the second end 604 at the upper end 606 of the upper clamp component 265. Each of the vertical clamp wall 610 and horizontal clamp wall 614 can be substantially planar in the present aspect and can meet at a curved joint 616, as shown. Furthermore, an arcuate fastener slot 620 can be defined through the curved joint 616, as described in further detail below. In the present aspect, the vertical clamp wall 610 can be monolithically formed with the horizontal clamp wall 614. However, in other aspects, the vertical clamp wall 610 may not be monolithically formed with the horizontal clamp wall 614.

The horizontal clamp wall 614 can define a rail opening 626 therethrough, proximate to the second end 604 of the upper clamp component 265. The horizontal clamp wall 614 can further define a clearance slot 628 extending from a rear side 615 of the horizontal clamp wall 614 to the rail opening 626. According to example aspects, the upper section 112 of the corresponding guardrail post 110 can extend through and slide within the rail opening 626 and the cross-rod 678 of the securing pin 172 can extend through and slide within the clearance slot 628 as the upper clamp component 265 is adjusted relative to the guardrail post 110, which is described in further detail below.

In the present aspect, the fastener slot 620 can define an upper slot end 622 at the horizontal clamp wall 614 and a lower slot end 624 at the vertical clamp wall 610. A distal end 680 of the threaded bolt 255 of the clamp fastener 250 can engage the lower slot end 624 of the fastener slot 620, as shown. Moreover, the upper clamp component 265 can comprise a slab engagement portion 613, which in the present aspect can be defined by the vertical clamp wall 610 at the lower end 608 of the upper clamp component 265. The slab engagement portion 613 can define upper teeth 612 extending substantially downward, relative to the orientation shown, at the lower end 608 of the upper clamp component 265. Referring to FIG. 8, which illustrates the upper bracket assembly 135 engaging the elevated floor slab 152, the clamp fastener 250 can be tightened by rotating the clamp fastener 250 within the threaded fastener channel 744 (shown in FIG. 7B). As the clamp fastener 250 is tightened, the distal end 680 of the clamp fastener 250 can push against the lower slot end 624 of the fastener slot 620 (shown in FIG. 6) to bias the upper clamp component 265 towards the elevated floor slab 152. The clamp fastener 250 can be tightened until the upper teeth 612 of the upper clamp component 265 engage and sufficiently grip the upper slab surface 154 of the elevated floor slab 152. One the clamp fastener 250 has been tightened as necessary, the threaded fastener nut 685 can be tightened on the clamp fastener 250 within the notch 642 to further secure the clamp fastener 250 in position relative to the upper support component 235.

Thus, a method of mounting the guardrail system 100 to the elevated slab 150 can comprise providing the guardrail system 100 comprising the lower bracket 140, the upper bracket assembly 135, and a plurality of the guardrails 105. Each of the lower bracket 140 and the upper bracket assembly 135 can be mounted to one of the guardrail posts 110 of the plurality of guardrails 105. The method can further comprise abutting the lower bracket 140 against the lower slab surface 156 of the elevated slab 150 and tightening the clamp fastener 250 against the upper clamp component 265 of the upper bracket assembly 135, wherein tightening the clamp fastener 250 against the upper clamp component 265 can bias the upper clamp component 265 against the upper slab surface 154 of the elevated slab 150.

Figure 9:
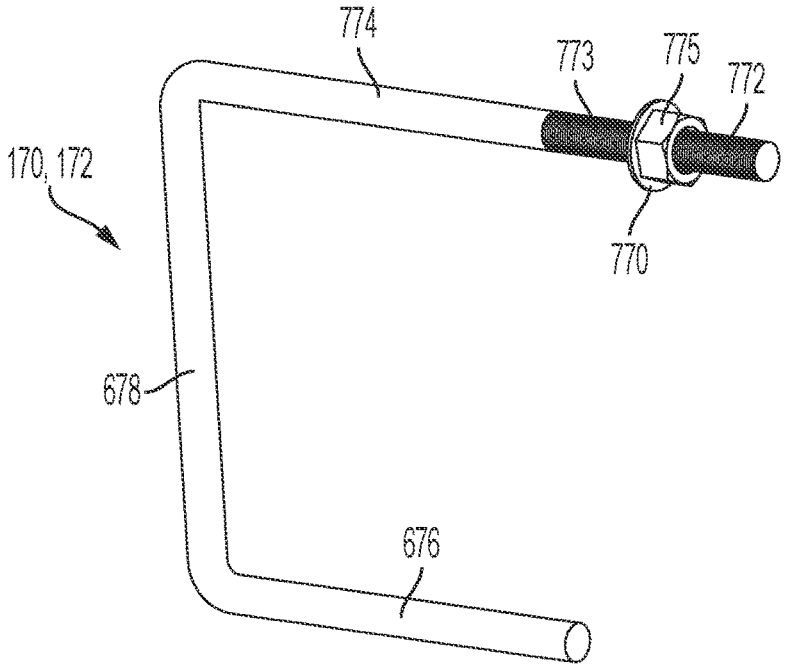
FIG. 9 is a perspective view of a securing pin.

FIG. 9 illustrates one of the securing pins 172 according to an example aspect of the present disclosure. As shown, the securing pin 172 can define the upper leg 774, the lower leg 676, and the cross-rod 678 extending therebetween. The upper leg 774 can be oriented about parallel with the lower leg 676, and the cross-rod 678 can be oriented about perpendicular to the upper leg 774 and the lower leg 676. In the present aspect, the upper leg 774 can define a length that is greater than a length of the lower leg 676. However, in other aspects, the upper leg 774 can be about equal in length to the lower leg 676, or the lower leg 676 can be greater in length than the upper leg 774. As described above, the upper leg 774 can define the threaded portion 773 at the distal end 772 thereof, and the washer 770 and the threaded pin nut 775 can be mounted to the threaded portion 773.

Figure 11:
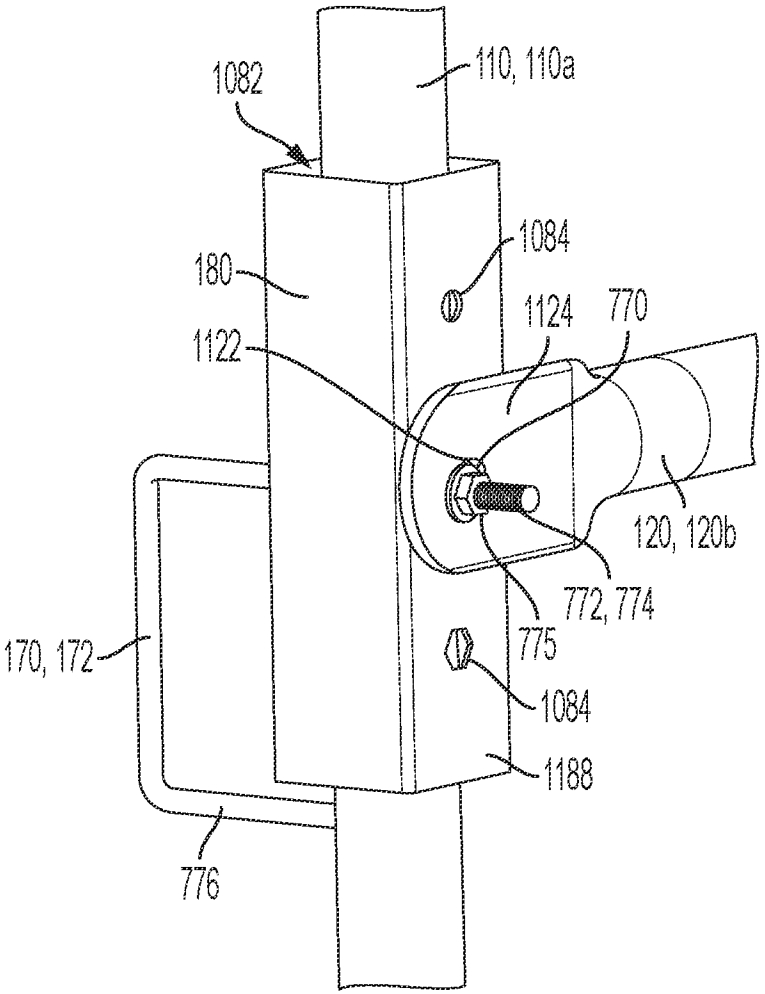
FIG. 11 is another perspective view of the lateral guardrail of FIG. 10 secured to the guardrail post of FIG. 10.
Figure 10:
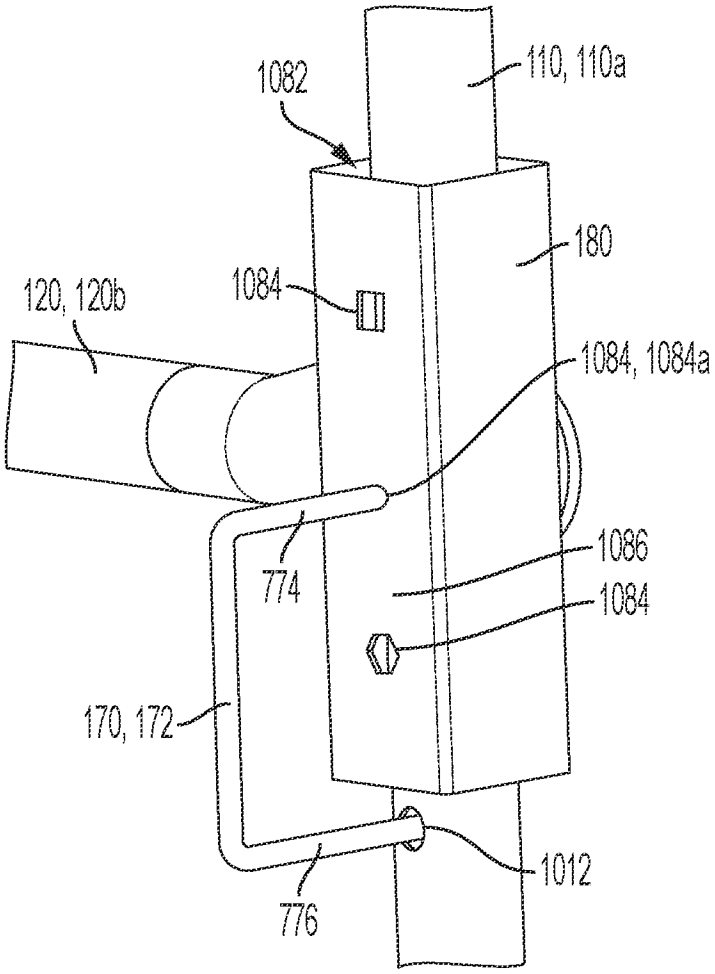
FIG. 10 is a perspective view of a lateral guardrail of the plurality of guardrails of FIG. 1 secured to a guardrail post of the plurality of guardrails.

FIGS. 10 and 11 illustrate perspective view of one of the lateral guardrails 120 secured to one of the guardrail posts 110. In some aspects, some or all of the lateral guardrails 120 can be directly secured to corresponding guardrail posts 110 with a fastener, such as, for example, one of the securing pins 172. For example, FIG. 1 illustrates the end guardrail post 110*d* directly secured to the corresponding upper and lower lateral guardrails 120*a,b*. Furthermore, in some aspects, one or more of the connector brackets 180 can be provided for securing some or all of the guardrail posts 110 to the corresponding lateral guardrails 120. The present view illustrates the end guardrail post 110*a* secured to the corresponding lower lateral guardrail 120*b*. Example aspects of the connector bracket 180 can be substantially rectangular can define a connector channel 1082 therethrough. The guardrail post 110 can extend through the connector channel 1082, as shown. The connector bracket 180 can further define one or more connector openings 1084 extending through a front side 1086 and a rear side 1188 (shown in FIG. 11) of the connector bracket 180, transverse to the connector channel 1082. The guardrail post 110 can further define one or more connector pinholes 1012 formed therethrough above the upper pinholes 812 (shown in FIG. 8), and one of the connector pinholes 1012 can be aligned with a corresponding one of the connector openings 1084. As shown, the upper leg 774 of a corresponding one of the securing pins 172 can extend through a center one of the connector openings 1084*a* and the aligned connector pinhole 1012. The lower leg 676 of the securing pin 172 can extend into another one of the connector pinholes 1012. As shown, in some aspects, the connector pinhole 1012 engaged by the lower leg 676 does not extend fully through the guardrail post 110; however, in other aspects, the connector pinhole 1012 can extend fully through the guardrail post 110.

Referring to FIG. 11, according to example aspects, a distal end 1124 of each of the lateral guardrails 120 can define an attachment opening 1122 therethrough. In the present aspect, the distal end 1124 of each of the lateral guardrails 120 can be substantially flat, such as by crimping the distal end 1124, as shown. The distal end 772 of the upper leg 774 of the securing pin 172 can further extend through the attachment opening 1122 in the lateral guardrail 120 to mount the lateral guardrail 120 on the securing pin 172. The threaded pin nut 775 can be tightened on the threaded portion 773 of the securing pin 172 to sandwich the distal end 1124 of the lateral guardrail 120 between the washer 770 and the rear side 1188 of the connector bracket 180. In aspects wherein two of the lateral guardrails 120 must be secured to same connector bracket 180 (for example, two of the upper lateral guardrails 120*a* or two of the lower lateral guardrails 120*b*, as shown in FIG. 1 with respect to the intermediate guardrail posts 110*b,c*), the upper leg 774 of the securing pin 172 can extend through the attachment openings 1122 of both lateral guardrails 120. The threaded pin nut 775 can then be tightened to sandwich the distal ends 1124 of both lateral guardrails 120 between the washer 770 and the rear side 1188 of the connector bracket 180.

One should note that the different aspects disclosed herein can be combined such that the pipe fitting can include the features of more than one aspect. One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A guardrail mounting bracket comprising;

a bracket assembly comprising a support component and a movable clamp component, the movable clamp component configured to slide along a guardrail, the clamp component defining an L-shape and comprising a substantially horizontal clamp wall and a substantially vertical clamp wall, the substantially horizontal clamp wall defining a first end and a second end opposite the first end, the substantially horizontal clamp wall configured to couple to the guardrail proximate the first end, the substantially vertical clamp wall extending from the substantially horizontal clamp wall at the second end;

a bracket, wherein the clamp component is oriented between the support component and the bracket; and a clamp fastener supported by the support component and configured to engage the clamp component, the clamp fastener movable relative to the support component to selectively slide the clamp component towards the bracket;

wherein:

the bracket is configured to slide along the guardrail towards and away from the bracket assembly, such that a distance between the clamp component and the bracket is adjustable by sliding either or both of the bracket and the clamp component along the guardrail;

the support component comprises a post engagement portion configured to engage the guardrail and a fastener support portion configured to support the clamp fastener;

the substantially horizontal clamp wall of the clamp component defines a rail opening proximate to the first end; and the rail opening is configured to receive the guardrail therethrough.

2. The guardrail mounting bracket of claim 1, wherein:

the post engagement portion defines a rail channel configured to receive the guardrail therethrough;

the post engagement portion defines a bracket opening transverse to the rail channel; and the bracket assembly further comprises a securing fastener engaging the bracket opening.

3. The guardrail mounting bracket of claim 2, wherein:

the post engagement portion of the support component is defined at a first end of the support component; and the post engagement portion is bent relative to the fastener support portion to define the rail channel.

4. The guardrail mounting bracket of claim 1, wherein the fastener support portion of the support component defines a threaded fastener channel, and wherein the clamp fastener is a threaded bolt rotatably engaging with the threaded fastener channel.

5. The guardrail mounting bracket of claim 4, wherein:

the threaded bolt defines a fastener head and a threaded fastener tail extending from the fastener head;

the fastener head abuts the fastener support portion at an upper end of the support component;

the fastener support portion defines a notch at a lower end of the support component opposite the upper end of the support component; and a threaded fastener nut is rotatably mounted on the threaded fastener tail and is tightened within the notch to abut the lower end of the support component.

6. The guardrail mounting bracket of claim 1, wherein the substantially vertical clamp wall of the clamp component further defines a slab engagement portion distal to the substantially horizontal clamp wall, the slab engagement portion defining a plurality of teeth extending towards the bracket.

7. The guardrail mounting bracket of claim 1, wherein the bracket comprises a post engagement portion configured to engage the guardrail and a slab contacting portion extending from the post engagement portion.

8. The guardrail mounting bracket of claim 7, wherein:

the post engagement portion defines a rail channel configured to receive the guardrail therethrough;

the post engagement portion defines a bracket opening transverse to the rail channel; and the bracket further comprises a positioning fastener engaging the bracket opening.

9. The guardrail mounting bracket of claim 8, wherein:

the bracket opening is one of a plurality of bracket openings spaced longitudinally along the post engagement portion; and the positioning fastener is selectively repositionable through each of the bracket openings.

10. The guardrail mounting bracket of claim 9, wherein:

the positioning fastener is a lock pin comprising a pin rod and a pin lock coupled to the pin rod;

the pin rod extends through one of the plurality of bracket openings;

the pin lock extends partially around an outside of the post engagement portion and defines a locking loop;

the lock pin is configurable in a locked configuration, wherein the locking loop is hooked onto a distal end of the pin rod, and an unlocked configuration, wherein the locking loop is unhooked from the distal end of the pin rod.

11. The guardrail mounting bracket of claim 8, wherein:

the post engagement portion of the bracket is defined at a first end of the bracket; and the post engagement portion is bent relative to the slab contacting portion to define the rail channel.

12. The guardrail mounting bracket of claim 7, wherein the slab contacting portion defines a plurality of teeth extending towards the bracket assembly.

13. The guardrail mounting bracket of claim 1, wherein the bracket assembly is an upper bracket assembly and the bracket is a lower bracket.

14. The guardrail mounting bracket of claim 1, wherein a curved joint is defined between the substantially horizontal clamp wall and the substantially vertical clamp wall.

15. The guardrail mounting bracket of claim 14, wherein a fastener slot is defined through the curved joint, the fastener slot defines an upper slot end and a lower slot end opposite the upper slot end, and a distal end of the clamp fastener engages the lower slot end.

16. The guardrail mounting bracket of claim 1, wherein the substantially horizontal clamp wall is substantially planar, the substantially vertical clamp wall is substantially planar, and the rail opening is substantially planar.

17. The guardrail mounting bracket of claim 1, wherein:

the substantially horizontal clamp wall defines a clearance slot extending from a first clamp side of the substantially horizontal clamp wall to the rail opening;

the support component defines a bracket slot formed in a first engagement portion side of the post engagement portion, the bracket slot extending from a lower end of the support component towards an upper end of the support component;

the bracket assembly further comprises a securing fastener, the securing fastener comprising an upper leg, a lower leg opposite the upper leg, and a cross-rod extending between the upper leg and the lower leg; and the upper leg extends laterally through the bracket slot and the cross-rod extends longitudinally through and is slidable within the clearance slot.

18. The guardrail mounting bracket of claim 17, wherein the post engagement portion defines a second engagement portion side opposite the first engagement portion, a bracket hole is defined through the second engagement portion side, and the upper leg further extends laterally through the bracket hole.

19. A guardrail mounting bracket comprising;

a bracket assembly comprising a support component and a movable clamp component, the movable clamp component configured to slide along a guardrail, the clamp component defining an L-shape and comprising a substantially horizontal clamp wall and a substantially vertical clamp wall, the substantially horizontal clamp wall defining a first end and a second end opposite the first end, the substantially horizontal clamp wall configured to couple to the guardrail proximate the first end, the substantially vertical clamp wall extending from the substantially horizontal clamp wall at the second end;

a bracket, wherein the clamp component is oriented between the support component and the bracket; and a clamp fastener supported by the support component and configured to engage the clamp component, the clamp fastener movable relative to the support component to selectively slide the clamp component towards the bracket;

wherein:

the bracket is configured to slide along the guardrail towards and away from the bracket assembly, such that a distance between the clamp component and the bracket is adjustable by sliding either or both of the bracket and the clamp component along the guardrail;

a curved joint is defined between the substantially horizontal clamp wall and the substantially vertical clamp wall;

a fastener slot is defined through the curved joint;

the fastener slot defines an upper slot end and a lower slot end opposite the upper slot end; and a distal end of the clamp fastener engages the lower slot end.

* * * * *